United States Patent [19]

Van Herck et al.

[11] 4,283,652

[45] Aug. 11, 1981

[54] GAS DISCHARGE LAMP HAVING SUPPORTING TONGUE FORMED FROM ELECTRODE FEEDTHROUGH

[75] Inventors: Andre J. B. M. Van Herck; Gerardus A. P. M. Cornelissen, both of Eindhoven, Netherlands

[73] Assignee: U.S. Philips Corporation, New York, N.Y.

[21] Appl. No.: 22,745

[22] Filed: Mar. 22, 1979

[30] Foreign Application Priority Data

Apr. 10, 1978 [NL] Netherlands ..... 7803763

[51] Int. Cl.[3] ..... H01J 61/36

[52] U.S. Cl. ..... 313/217; 313/283

[58] Field of Search ..... 313/217, 283

[56] References Cited

U.S. PATENT DOCUMENTS 3,351,803 11/1967 Kearney ..... 313/217 X 4,052,635 10/1977 Jacobs ..... 313/217

FOREIGN PATENT DOCUMENTS 899090 12/1953 Fed. Rep. of Germany ..... 313/217

*Primary Examiner*—Robert Segal

*Attorney, Agent, or Firm*—Robert S. Smith

[57] ABSTRACT

Electric discharge lamp having a cylindrical ceramic discharge vessel, closed in a vacuum-tight manner, the wall of which incorporates a current feedthrough member, which extends outside the discharge vessel and is provided there, for bearing on the discharge vessel, with at least one outwardly-extending tongue formed by disturbing the outer surface of the current feedthrough member.

2 Claims, 3 Drawing Figures

GAS DISCHARGE LAMP HAVING SUPPORTING TONGUE FORMED FROM ELECTRODE FEEDTHROUGH

Figure 1:
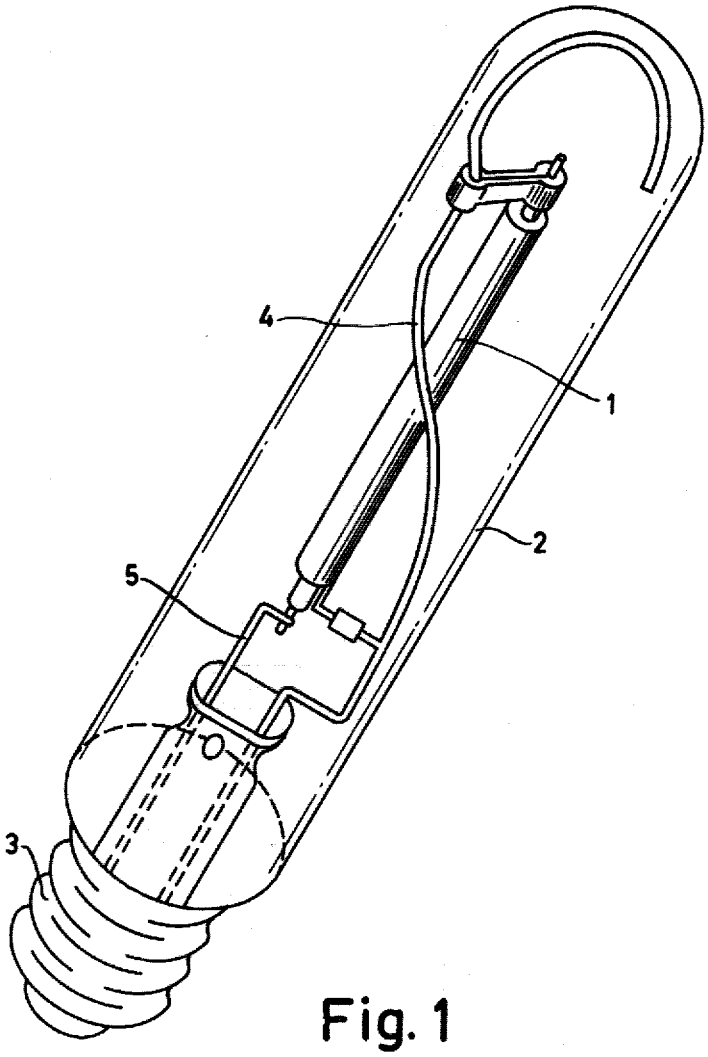

The invention relates to an electric discharge lamp of the type having a tubular ceramic discharge vessel sealed in a vacuum-tight manner, a metal current feedthrough member of an electrode being accommodated in the wall of the discharge vessel. The current feedthrough member extends outside the discharge vessel and comprises there positioning means for positioning the member directly or indirectly with respect to the discharge vessel during assembly. Such a lamp is disclosed in U.K. Pat. No. 1,205,871.

The discharge vessel of discharge lamps which have a high operating temperature (for example 1000° C. or higher) usually consists of a ceramic material, such as a polycrystalline material (for example translucent gas-tight aluminium oxide) or a monocrystalline material (for example sapphire). As a rule the discharge vessel is closed by means of ceramic end plugs which are connected in a vacuum-tight manner to the wall of the tubular discharge vessel by means of sealing glass and/or by sintering. The current feedthrough member of the electrode is accommodated in the plug, for example by means of sealing glass. Generally such a current feedthrough member is rod-shaped or tubular and consists of a metal such as niobium or tantalum having a linear coefficient of expansion which is approximately equal to, or deviates only little from that of the ceramic material. The electrode is secured to the current feedthrough member by means of, for example, soldering or welding.

An important condition for proper functioning of the lamp is that the correct position of the electrode in the discharge vessel is ensured. The operating voltage of the lamp is predominantly determined by the distance over which the tip of the electrode projects into the discharge vessel. To prevent fluctuations in the value of the operating voltage for different lamps having discharge vessels of the same dimensions and operated in identical circumstances, it is necessary to reduce deviations of this distance to a minimum.

For the positioning and bearing of the current feedthrough member the above-mentioned United Kingdom Patent proposes to secure a narrow strip or wire, for example of molybdenum, to the portion of the current feedthrough member which projects from the discharge vessel. The use of loose components, such as narrow strips, rings and such like during the manufacture of the lamp is, however, time-consuming, and special tools are required for securing such components to the current feedthrough member. In addition, the current feedthrough member may be damaged during the process.

It is an object of the invention to provide a lamp wherein the proper position of the electrode in the discharge vessel is ensured by means of positioning means which can be formed in a simple manner from the metal of the current feedthrough member itself.

In accordance with the invention an electric discharge lamp of the type defined in the preamble is characterized in that the positioning means comprises of at least one tongue, extending radially outwardly of the feedthrough member and formed by disturbing solely the outer surface metal of the current feedthrough member.

A lamp having a positioning means according to the invention is formed during manufacture of the lamp in a simple manner from the current feedthrough member. Namely, it is sufficient to clamp the current feedthrough member, consisting, for example of a tube or a pin of a suitable metal such as niobium, for a short time only whereafter a thin surface layer of the outer wall of the current feedthrough member is disturbed by scraping so as to form one or more snags or tongues projecting from the walls. Alternatively, it is possible to form the tongues by means of a sloping partial incision in the surface of the wall and to force the incised portion outwardly. Such a procedure does not require separate loose components and addition auxiliary means. Mounting the feedthrough assembly can therefore be easily mechanised.

In an embodiment of a lamp according to the invention there are several tongues located in a cross-section perpendicular to the longitudinal axis of the current feedthrough member and spaced along the circumference.

In this embodiment a uniform positioning of the current feedthrough member on the plug and the discharge vessel is more easily obtained. This is especially important if a plug is used which envelopes the current feedthrough member with a slight amount of clearance. During manufacture of the lamp the positioning of the current feedthrough member in the direction of the longitudinal axis of the discharge vessel is thus prevented from being disturbed when the sealing glass is applied between the current feedthrough member and the plug.

Generally, the positioning means according to the invention is located on the outside of the discharge vessel. It is, however, conceivable that in an embodiment the means bears on the plug side facing the electrode.

It should be noted that Applicant's nonprepublished Netherlands patent application No. 7612120 discloses an electric gas discharge lamp having a ceramicdischarge vessel wherein the current feedthrough member is provided at its projecting portion with a positioning means for the plug. In accordance with that Application this means may be a helically wound wire or a cross-connection but it is also described that the means may be formed by bending the free formed end of the current feedthrough member back on itself to extend towards the direction of the discharge vessel. This indeed furnishes a proper support of the current feedthrough member without additional auxiliary means, but during manufacture this construction requires a bending operation wherein it is difficult to adjust the proper distance of the electrode to the plug, (this distance partly determines the operation voltage of the lamp). Furthermore, there is the risk of disturbing the proper orientation of the current feedthrough member.

Figure 2:
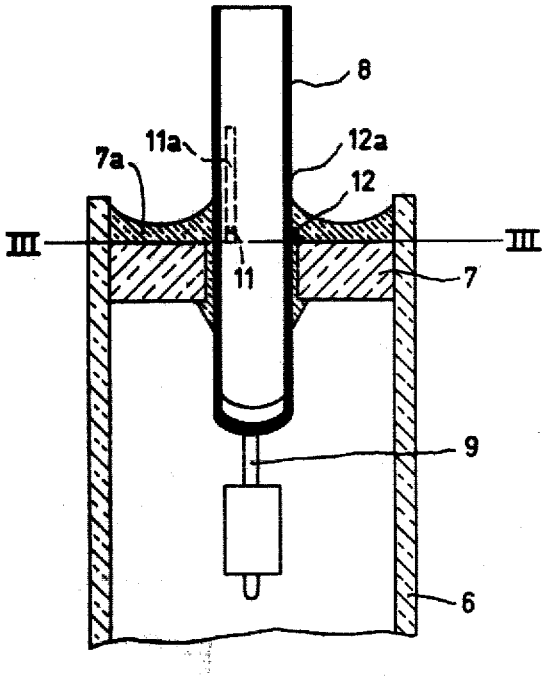
Figure 3:
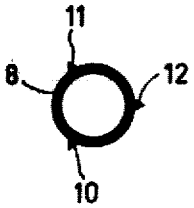

An embodiment of the invention will now be described, by way of example, with reference to the accompanying drawing, of which FIG. 1 shows an electric discharge lamp according to the invention FIG. 2 shows a longitudinal cross-section of an end of the discharge vessel of the lamp shown in FIG. 1, and FIG. 3 shows a cross-section through the plane III—III of a tubular feedthrough member of a lamp according to the invention.

In FIG. 1 reference numeral 1 denotes a cylindrical discharge vessel consisting of polycrystalline transparent gas-tight aluminium oxide. Reference numeral 2 denotes the outer bulb of the discharge lamp. Reference numeral 3 denotes the lamp base. Reference numerals 4 and 5 denote the pole-wires. These pole-wires have for their purpose to have the discharge vessel bear on the outer bulb and to feed current to the electrodes.

In FIG. 2 reference numeral 6 denotes an end-portion of the wall of the cylindrical discharge vessel 1 of FIG. 1. A partial closing of the end of the discharge vessel is realised by means of a ceramic end plug 7, consisting like the ceramic discharge vessel of transparent gas-tight aluminium oxide, which is crimp-fitted and sintered to the wall 6. A tubular current feedthrough member 8, consisting of niobium, is located in the ring 7. The current feedthrough member is soldered to a tungsten electrode 9 by means of titanium. The capillary space between the tubular niobium current feedthrough member 8 and the ceramic end plug 7 as well as the external annular space between wall band 6 and the tubular niobium current feedthrough 8 is closed by means of a fusible material *7a*, for example glass. The portion of the current feedthrough member extending to outside the discharge vessel bears on the ceramic plug 7 and indirectly on the discharge vessel by means of several tongues 10, 11 and 12 (see FIG. 3), located in a cross-section perpendicular to the longitudinal axis of the current feedthrough member 8 and are evenly spaced around the circumference. These bearing tongues are formed by scraping off a portion of the outer wall of the tubular niobium current feedthrough 8. The scraped portions where the wall is disturbed to form the tongues 11 and 12 are denoted by 11*a* and 12*a*. In the above described embodiment, three tongues are used to ensure accurate positioning of the feed-through member. If the gap between member and plug is very small, however, a single tongue may be sufficient.

In a practical embodiment of a high-pressure sodium vapor discharge lamp having a power of 250 W, the discharge vessel 1 had an outside diameter of 3.0 mm, and an inside diameter of approximately 2.0 mm. The discharge vessel (approximately 60 mm long) is partly closed at both ends by means of 1.5 mm thick end plugs 7 of transparent, gas-tight aluminium oxide. The connection between the discharge vessel and the helical plugs was realized in a hydrogen atmosphere at 1850° C., a tight sintered connection being formed between said components by means of shrinking. Prior to assembly the helical end plugs 7 were pre-fired to a higher temperature than the discharge vessel.

The tubular niobium current feedthrough member 8 has an outside diameter of approximately 1.2 mm. The outer wall of this can was scraped over a length of approximately 2 mm to form tongues, which are substantially at right angles to the wall and which are approximately 0.2 mm thick and 0.7 mm long. At the above-mentioned power the luminous intensity of the lamp was 27000 Lumen at a line voltage of 220 V.

What is claimed is:

1. An electric discharge lamp having a tubular ceramic discharge vessel which is closed in a vacuum-tight manner by an end plug, a metal current feedthrough member of an electrode being accommodated in said end plug, said metal current feedthrough member extending outside the discharge vessel through said end plug, said metal current feedthrough further comprising outside of said vessel a positioning means comprising at least one tongue extending outwardly of the feedthrough member and formed by solely disturbing the outer surface metal of the current feedthrough member, said tongue contacting the external surface of said end plug, and sealing glass disposed around said feedthrough member and contacting the exterior surface of said end plug, whereby the longitudinal position of said electrode is maintained during assembly.

2. An electric discharge lamp as claimed in claim 1, characterized in that a plurality of said tongues is provided which tongues are located in a cross-section perpendicular to the longitudinal axis of the current feedthrough member and evenly spaced around the circumference thereof.

* * * * *